US005926667A

United States Patent [19]

Sugiura

[11] Patent Number: 5,926,667

[45] Date of Patent: Jul. 20, 1999

[54] IMAGE FORMING APPARATUS FOR PREVENTING TONER DETERIORATION CAUSED BY TONER TEMPERATURE RISE

[75] Inventor: Toshio Sugiura, Anjo, Japan

[73] Assignee: Brother Kogyo Kabushiki Kaisha, Nagoya, Japan

[21] Appl. No.: 08/824,343

[22] Filed: Mar. 26, 1997

[30] Foreign Application Priority Data

May 17, 1996 [JP] Japan ..... 8-123746

[51] Int. Cl.[6] ..... G03G 15/00

[52] U.S. Cl. ..... 399/29; 399/37; 399/88; 399/94

[58] Field of Search ..... 399/27, 29, 36, 399/37, 94, 25, 88

[56] References Cited

U.S. PATENT DOCUMENTS

| | | | |
|---|---|---|---|
| 5,101,228 | 3/1992 | Nishikawa et al. | 399/35 |
| 5,457,516 | 10/1995 | Kim | 399/37 |
| 5,506,665 | 4/1996 | Ishida et al. . | |

FOREIGN PATENT DOCUMENTS 9-026700 1/1997 Japan .

*Primary Examiner*—Arthur T. Grimley
*Assistant Examiner*—Quana Grainger
*Attorney, Agent, or Firm*—Oliff & Berridge, PLC

[57] ABSTRACT

An image forming apparatus suppresses a thermal deterioration of toner. The image forming apparatus has a toner box containing toner for developing an electrostatic latent image formed on a photosensitive drum, and at least one electric circuit, for example, a drive circuit for a polygon motor or a toner sensor, disposed near the toner box. The image forming apparatus judges, based on predetermined conditions, whether supplying electric power to the electric circuit is necessary. If the judgment is affirmative, electric power is supplied to the at least one electric circuit. Alternatively, if the judgment is negative, electric power is not supplied to the at least one electric circuit. By so doing, it is possible to suppress the rise in temperature of the toner, which deteriorates the toner quality. Thus, the image forming apparatus obviates a negative influence that degrades the image quality.

13 Claims, 3 Drawing Sheets

IMAGE FORMING APPARATUS FOR PREVENTING TONER DETERIORATION CAUSED BY TONER TEMPERATURE RISE

BACKGROUND OF THE INVENTION

1. Field of the Invention

The invention relates to an image forming apparatus using toner such as a printer, a facsimile device and a copying machine.

2. Description of Related Art

According to the prior art, for example in the laser beam printer disclosed in U.S. Pat. No. 5,506,665, a motor for driving a polygon mirror that deflects a laser beam and a drive circuit for the motor are disposed in the vicinity of the toner contained in the printer. Even while the image forming operation is not performed and the polygon mirror is OFF, electric power is supplied to the drive circuit for the motor. Thus, the printer is ready to restart quickly.

However, if the motor driving circuit stands while being supplied with electric power, the circuit generates heat. Consequently, the toner temperature rises and the toner deteriorates. As a result, the image quality may be poor.

SUMMARY OF THE INVENTION

This invention provides an image forming apparatus suppressing thermal deterioration of the toner. This image forming apparatus solves the aforementioned problems and the degraded image quality.

An image forming apparatus of this invention includes a toner box containing toner for developing an electrostatic latent image formed on an image bearing member; a discriminator that judges, based on predetermined conditions, whether it is necessary to supply electric power to at least one electric circuit near the toner box; and a power supply control device that permits the supply of electric power to the electric circuit when the result of the judgment is affirmative. Further, the power supply control device inhibits the supply of electric power to the electric circuit when the result of the judgment is negative.

In the first aspect of the invention, electric power is supplied to at least one electric circuit located near the toner box only when it is required. Thus, there is no wasteful heat generation from that electric circuit. Accordingly, the amount of heat generated in the vicinity of the toner box decreases to suppress the rise of the toner temperature. As a result, it is possible to prevent deterioration of the toner quality and hence deterioration of image quality, which is caused by deteriorated toner quality.

The image forming apparatus can further include an optical member for conducting light, the light forming an electrostatic latent image, to the image bearing member; a drive motor for operating the optical member to scan the image bearing member with the light; and a drive circuit for driving the drive motor and disposed near the toner box. In addition, the discriminator judges whether it is necessary to supply electric power to the drive circuit based on whether it is necessary to drive the optical member. Thus, electric power is supplied to the drive circuit only when it is necessary to operate the optical member by the drive motor. When it is not necessary to operate the drive motor, the supply of electric power to the drive circuit is inhibited. Therefore, it is possible to prevent wasteful heat generation from the drive circuit for the drive motor operating the optical member and to prevent an increase of the toner temperature.

For an image forming apparatus where the drive circuit for driving the drive motor is disposed under the toner box, the generation of heat from the drive circuit and the rise of toner temperature are more greatly correlated. In this case, the toner temperature rise preventing effect of this invention based on the suppression of heat generation from the drive circuit becomes more pronounced.

The image forming apparatus can also include an agitator device for agitating toner and a toner sensor for detecting a residual amount of toner in the toner box. In this case, the discriminator judges whether it is necessary to supply electric power to the toner sensor based on whether the agitator device is operating.

When toner is being agitated in the toner box, electric power is supplied to the toner sensor and a residual amount of toner is detected. When the agitator device is OFF, the toner may not be uniformly distributed in the toner box. If the amount of residual toner is detected by the toner sensor when the agitator is off, the detected value is less reliable. Because the image forming apparatus accurately detects the amount of toner only when it is being agitated, it is possible to prevent wasteful power supply to the toner sensor to minimize the generation of heat from the toner sensor. Thus, the deterioration of toner quality and the resulting deterioration of image quality can be further obviated.

The discriminator can further judge whether it is necessary to supply electric power to an electric circuit near the toner box based on whether a predetermined form of data for forming an electrostatic latent image is present. Based on the discriminator, the supply of electric power to the electric circuit is stopped until image forming data are processed to the predetermined form. Accordingly, wasteful power generation in the electric circuit at a preparatory stage for image formation or in a rest state is prevented to suppress the rise of toner temperature. Thus, it is possible to prevent deterioration of the toner quality and the resulting deterioration of image quality.

The image forming apparatus can also include a process device, a discriminator, at least one electric circuit and a power supply control device. The process device forms a toner image on a recording medium by the use of toner. The discriminator judges in accordance with predetermined conditions whether it is necessary to supply electric power to the at least one electric circuit disposed near the process device. The power supply control device permits the supply of electric power to the at least one electric circuit when the result of the judgment is affirmative and inhibits the supply of electric power to the at least one electric circuit when the result of the judgment is negative. Thus, electric power is supplied to the at least one electric circuit located near the process device only when it is required. Consequently, the rise in temperature of the toner, which is contained in the process device is suppressed to obviate the deterioration of toner quality and the resulting deterioration of image quality.

These and other features and advantages of this invention are described in or are apparent from the following detailed description of the preferred embodiments.

BRIEF DESCRIPTION OF THE DRAWINGS

The preferred embodiments of the invention will be described in detail with reference to the accompanying figures wherein.

DETAILED DESCRIPTION OF PREFERRED EMBODIMENTS

Figure 1:
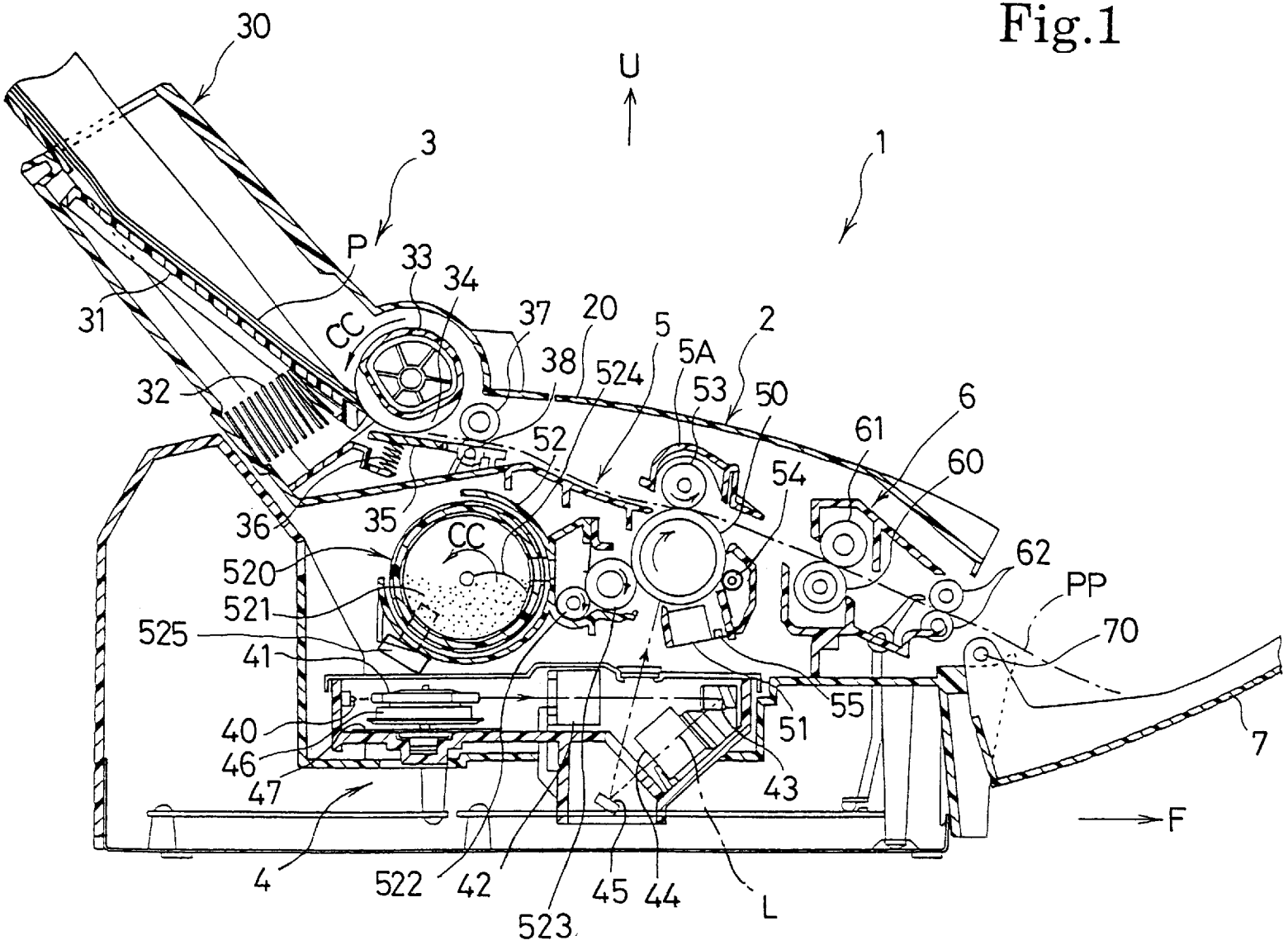
FIG. 1 is a sectional view of a laser beam printer according to an embodiment of the invention.

FIG. 1 illustrates a representative structure of a laser beam printer 1 embodying the preferred embodiments of this invention. In the following description, the direction of arrow F shown in FIG. 1 is a forward direction and the direction of arrow U is an upward direction.

The laser beam printer 1 includes a body case 2, a paper feed unit 3 for feeding paper P, a laser scanner unit 4 for forming an electrostatic latent image, a process unit 5 for changing the electrostatic latent image into a visible image and transferring the visible image onto the paper P, a fixing unit 6 for fixing the visible image on the paper P and a paper discharge tray 7 for stacking sheets of the paper P after printing.

The paper feed unit 3 includes a paper feed cassette 30 that is removably attached to the body case 2. In the paper cassette 30 is a push-up plate 31 on which sheets of the paper P can be stacked. Stacked sheets of the paper P on the push-up plate 31 are pushed against a paper feed roller 33 and a paper pressing collar 34 by a spring 32. In this state, when the paper feed roller 33 rotates in the direction shown by the arrow CC (counter-clockwise) in FIG. 1, the sheets are sent out from the paper feed cassette 30.

In front of the cassette 30 is a separator wall 35. Separation of the sheets of the paper P thus sent out is urged by both inclination of the separator wall 35 and the force of a spring 36, which pushes the separator wall 35 toward the paper feed roller 33. As a result, a top sheet in the paper feed cassette 30 is pulled apart from the other sheets of the stacked paper P and is sent downstream by the resist rollers 37 and 38. The sheet of paper P then travels to the paper discharge tray 7 along a path indicated by the broken line PP in FIG. 1.

The laser scanner unit 4 is mounted at a low position in the body case 2. Inside the laser scanner unit 4 is a laser beam generator 40. A laser beam L emitted from the laser beam generator 40, as indicated with arrows in FIG. 1, is conducted onto a photosensitive drum 50 in the process unit 5 via a polygon mirror 41, a lens 42, a mirror 43, a lens 44 and a mirror 45. Under the polygon mirror 41 are a polygon motor 46 and a drive circuit 47 for driving the polygon motor 46. The polygon motor 46 drives the polygon mirror 41 to rotate about a vertical axis in synchronization with the emitted laser beam L. The polygon mirror 41 rotation scans the laser beam L in the axial direction of the photosensitive drum 50 (i.e., in the direction perpendicular to the paper surface in FIG. 1).

The process unit 5 inside the body case 2 covers the laser scanner unit 4 from above. By opening and closing an upper cover 20 formed in the body case 2, the process unit 5 can be accessed to be mounted to and removed from the body case 2. Within a case 5A of the process unit 5 are the photosensitive drum 50, a charging device 51, a developing unit 52 and a transfer roller 53. The photosensitive drum 50 and the transfer roller 53 rotate about their respective axes in the directions shown by arrows in FIG. 1 under force from a main motor (not shown) mounted with the body case 2. The charging device 51 can be a known scorotron charging device. The charging device 51 induces corona discharge between it and the photosensitive drum 50 to electrically charge the photosensitive drum 50. The laser scanner unit 4 radiates the laser beam L to the outer periphery of the charged photosensitive drum 50. A potential difference created between the portion of the photosensitive drum 50 irradiated with the laser beam L and the portion not irradiated forms an electrostatic latent image.

A toner box 520 holding toner 521 is a double cylinder structure. The developing unit 52 supplies the toner 521 to the outer periphery side of the photosensitive drum 50 via a feed roller 522 and a developing roller 523. The toner 521 adheres onto the photosensitive drum 50 according to a charged state of the photosensitive drum 50 to form or develop a visible image corresponding to the electrostatic latent image on the photosensitive drum 50. In the interior of the toner box 520, an agitator 524 is mounted for agitating the toner 521. The agitator 524 is rotated about the central line of the toner box 520 by the foregoing main motor (not shown). The agitator 524 is rotated in the direction shown by the arrow CC in FIG. 1.

The toner 521 is a powdered mixture having, for example, resin, wax, silica and carbon black. Silica is used as a charge controlling and fluidity imparting agent. However, if the temperature of the toner 521 rises beyond a predetermined level, deterioration of fluidity and charging performance occurs. In other words, the fixing operation is not satisfactory.

Below the toner box 520 is a toner sensor 525 for detecting a residual amount of the toner 521. The toner sensor 525 emits a predetermined detection light to the toner 521, which is being agitated by the agitator 524, and detects a residual amount of the toner 521 in the toner box 520 using the intensity of reflected light or transmitted light. However, detecting a residual amount of the toner 521 is not limited to an optical method using the toner sensor 525. For example, an actuator in the toner box 520 could detect the residual amount.

The transfer roller 53 contacts the upper end of the photosensitive drum 50. The paper P is conducted to this contact area. An electric field is formed between the photosensitive drum 50 and the transfer roller 53 to transfer the toner image formed on the photosensitive drum 50 to the paper P. After transferring the toner image, the toner remaining on the photosensitive drum 50 is removed by a cleaning roller 54 and the electric charge remaining on the photosensitive drum 50 is removed by a discharging lamp 55. The residual toner transferred onto the cleaning roller 54 is returned onto the photosensitive drum 50 at a time that does not obstruct the formation of an electrostatic latent image. The toner returned to the photosensitive drum 50 is recovered into the developing unit 52 via the developing roller 523.

The fixing unit 6 is adjacent the process unit 5 on the downstream side. In the fixing unit 6 are a pair of contacting rollers 60 and 61. The paper P with the toner image transferred thereon is pressed between both rollers 60 and 61. One roller 60 includes a halogen lamp (not shown) as a heating device to heat the paper P. The pressing and heating fixes the toner image to the paper P. After the toner image is fixed, the paper P is discharged onto the paper discharge tray 7 using a pair of discharge rollers 62. The paper discharge tray 7 connects to the front side of the body case 2 to open and close using connecting portions 70 that are formed at end rear side of the paper discharge tray.

Figure 2:
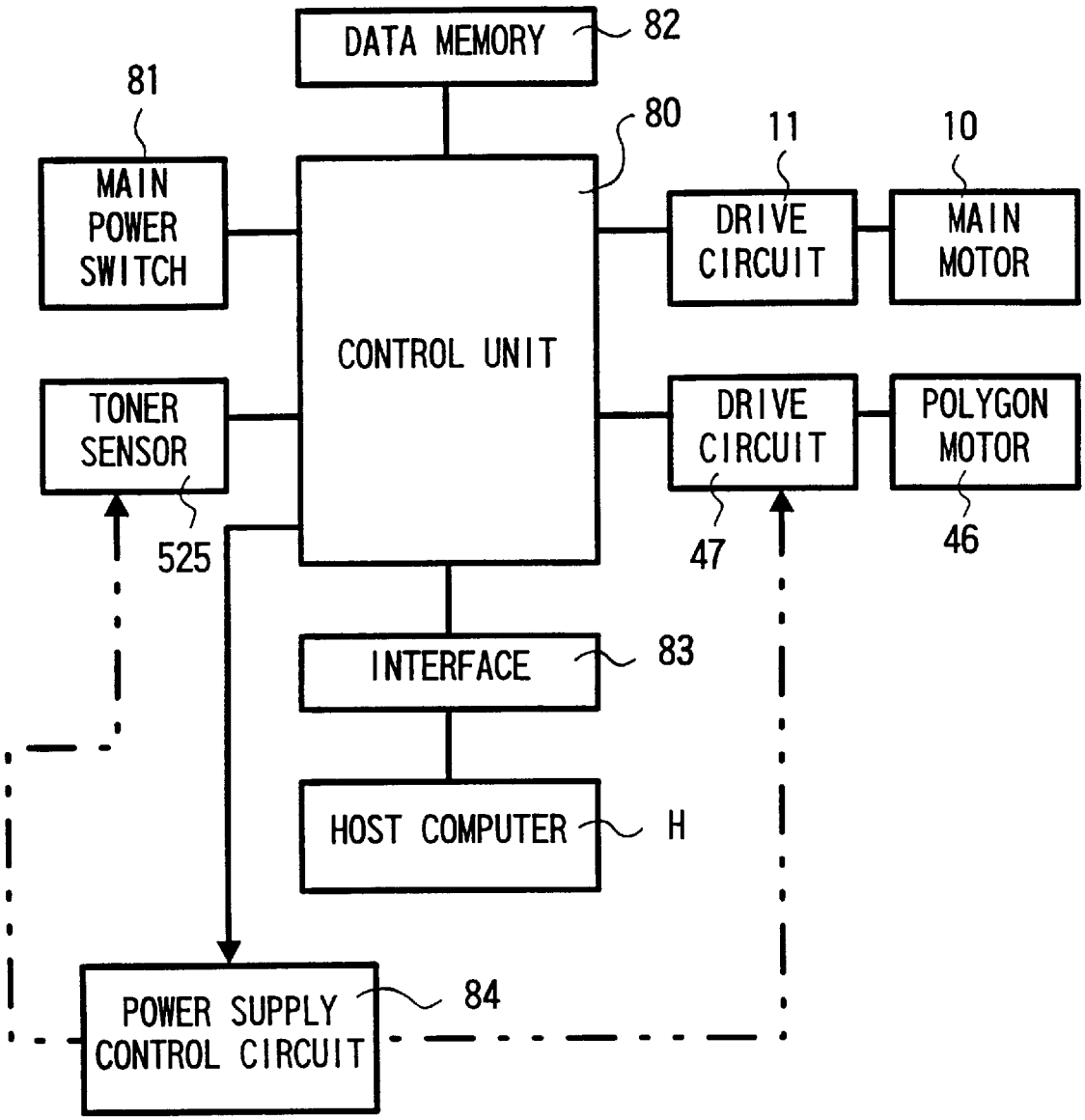
FIG. 2 is a block diagram showing a principal portion of a control system used in the laser beam printer of FIG. 1.

FIG. 2 is a block diagram of portions of a control system used in the laser beam printer 1 shown in FIG. 1. The control system includes a control unit 80. As shown in FIG. 2, the control unit 80 is preferably implemented on a programmed microprocessor or microcontroller and peripheral integrated circuit elements.

However, the control unit 80 can also be implemented on an ASIC or other integrated circuit, a hardwired electronic or logic circuit such as a discrete element circuit, a programmable logic device such as a PLD, PLA, FPGA or PAL, or the like. In general, any device on which a finite state machine capable of implementing the flowcharts shown in FIG. 3 can be used to implement the control circuit 80.

The control unit 80 executes arithmetic processings and various programs necessary to operate various components of the laser beam printer 1. The main motor 10 connects to the control unit 80 through a drive circuit 11. The polygon motor 46 connects to the control unit 80 through the drive circuit 47. As mentioned previously, the main motor 10 rotates the photosensitive drum 50 and the agitator 524 of the developing unit 52. The toner sensor 525 is also connected to the control unit 80. When the residual amount of toner detected by the toner sensor 525 becomes smaller than a predetermined value, the control unit 80 issues a predetermined warning to the user. The predetermined warning can be, for example, display of a warning message on an operation panel (not shown).

Further, a main power switch 81, a data memory 82, such as a semiconductor memory, and an interface 83 connect to the control unit 80. The main power switch 81 turns on and off the entire power supply of the laser beam printer 1. A host computer H connects to the interface 83 to supply printing data in a predetermined format. Under control of the control unit 80, a power supply control circuit 84 permits or inhibits the supply of electric power from a power supply circuit (not shown) to the toner sensor 525 using a predetermined timing. The power supply control circuit 84 also permits or inhibits the supply of electric power to the drive circuit 47 for the polygon motor 46 using a predetermined timing. Thus, the control unit 80 controls the supply of electric power at a predetermined timing to the toner sensor 525 and the drive circuit 47.

In addition to the above components, various other conventional devices and circuits, includes, for example, a known lighting control circuit for the halogen lamp in the fixing unit 6 and a known control circuit for the laser beam generator 40, are connected to the control unit 80. Accordingly, explanations thereof are omitted.

Figure 3:
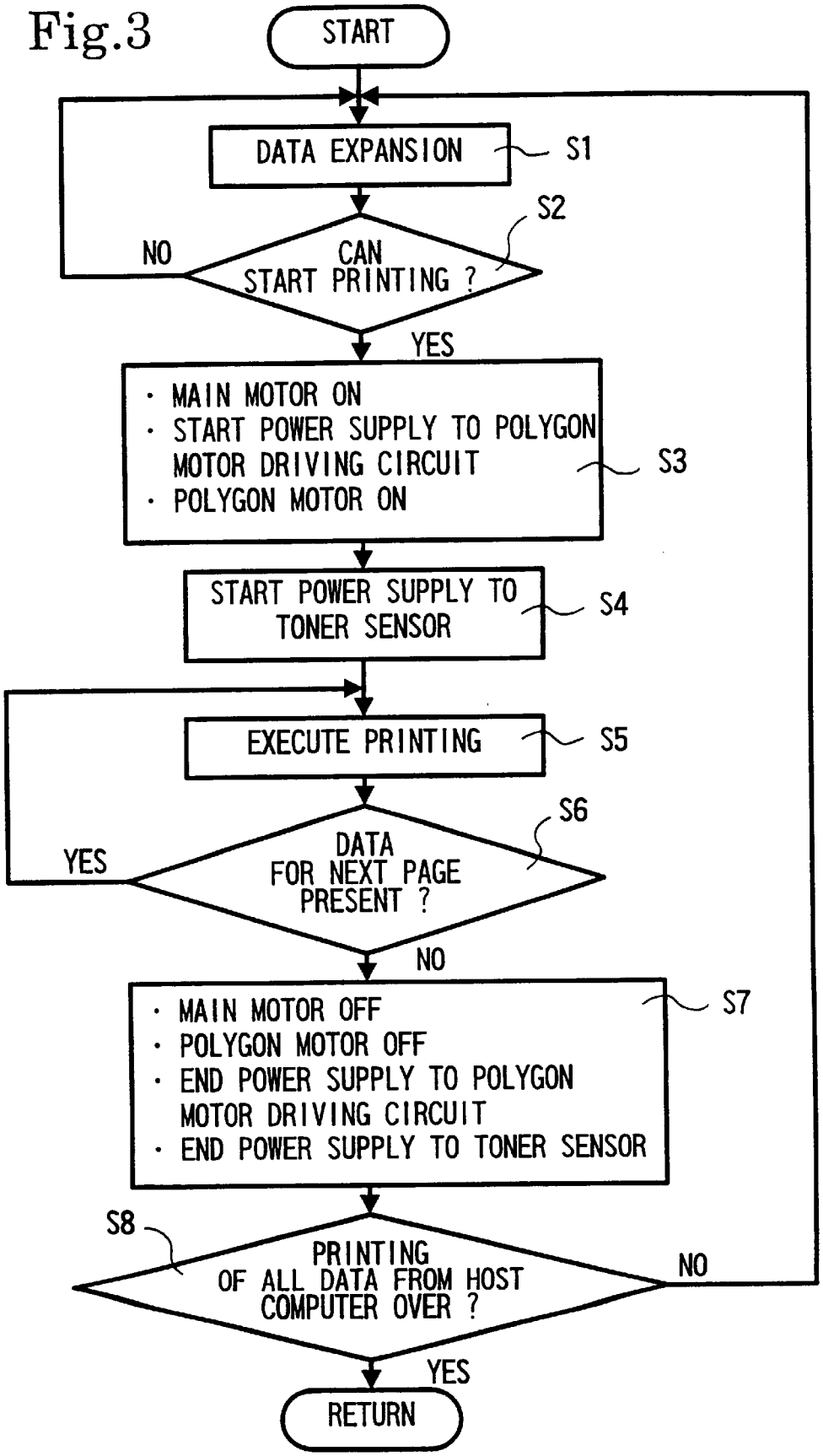
FIG. 3 is a flow chart showing a subroutine process in the execution of printing performed by a control unit shown in FIG. 2.

FIG. 3 is a flow chart showing a subroutine process executed on printing data supplied from the host computer H.

Upon receipt of printing data from the host computer H, the control unit 80 writes the data to the data memory 82 (shown in FIG. 2) and starts the process of FIG. 3. First, in step S1, the data stored in the data memory 82 is converted to data having a predetermined format. Thus, in step S1, the printing data is converted from the host computer H into page-by-page printing data that conforms to specifications of the laser beam printer 1. From step S1, control advances to step S2. In step S2, the control system judges whether printing can be started based on whether at least one page of data has been prepared. If the judgment in step S2 is affirmative, control advances to step S3. If the judgment in step S2 is negative, control returns to step S1.

In step S3, a drive command is provided to the drive circuit 11 to start the rotation of the main motor 10. At the same time, a power supply start signal is provided to the power supply control circuit 84 to start the supply of electric power to the drive circuit 47 for the polygon motor 46. Then, a drive command is issued to the drive circuit 47 to start rotation of the polygon motor 46. In other words, the supply of electric power to the drive circuit 47 for the polygon motor 46 is stopped until issuance of a drive command to the drive circuit 11. Thus, the drive circuit 47 is started simultaneously with or just before the drive command to the drive circuit 11 is issued. While printing is not performed, it is not necessary to drive the polygon mirror 41. Limiting the power supply period in this manner suppresses heat generated from the drive circuit 47 without obstructing the operation of the laser beam printer 1.

After start-up of the main motor 10 and the polygon motor 46 in step S3, control advances to step S4. In step S4, a signal indicating the start of power supply to the toner sensor 525 is issued to the power supply control circuit 84. Thus, the supply of electric power to the toner sensor 525 is interlocked with the start-up of the main motor 10 to obtain reliable detections and to prevent heat generation. While the main motor 10 is OFF and the agitator 524 is not agitating, the toner 521 in the toner box 520 is not uniformly distributed. In this case, the value detected by the toner sensor 525 is not reliable, so the electric power supply to the toner sensor is stopped to prevent wasteful heat generation. From step S4, control advances to step S5.

In step S5, printing is executed. In particular, the control unit 80 controls the paper feed unit 3, the laser scanner unit 4, the process unit 5 and the fixing unit 6 using a known electrophotographic process to print page by page. After printing one page, control advances to step S6. In step S6, the control system judges whether printing data for the next page have been prepared. If the judgment in step S6 is affirmative, control returns to step S5, where printing of the next page is started. On the other hand, if the judgment in step S6 is negative, because there are no data for printing the next page, control advances to step S7.

In step S7, the drive signals to the drive circuit 11 for the main motor 10 and to the drive circuit 47 for the polygon motor 46 is stopped to turn OFF both motors 10 and 46. At the same time, a power supply inhibit signal is provided to the power supply control circuit 84 to stop the supply of electric power to both the drive circuit 47 and the toner sensor 525 to prevent wasteful heat generation around the toner box 520. From step S7, control advances to step S8.

In step S8, the control system judges whether printing of all the data fed from the host computer H has been completed. If the judgment in step S8 is negative, control returns to step S1. However, if the judgment in step S8 is affirmative, the processing of the subroutine shown in FIG. 3 is ended and control returns to the main routine.

In this embodiment, as described above, the supply of electric power to the toner sensor 525 and to the drive circuit 47 for the polygon mirror 46 is stopped until just before printing becomes feasible by preparing one page of printing data. Also during the period after completion of printing a current page until printing the next page becomes feasible, electric power is not supplied to the toner sensor 525 and the drive circuit 47. Further, during the period after completion of printing the last page of a document and before the start of printing based on the next document, electric power is not supplied to the toner sensor 525 and the drive circuit 47 so that the heat generated from the toner sensor 525 and the drive circuit 47 is minimized. Accordingly, even if the toner sensor 525 and the drive circuit 47 are positioned just under the toner box 520, it is possible to prevent the rise in temperature of the toner 521 caused by heat generation from the sensor 525 and the drive circuit 47. Consequently, it is possible to prevent deterioration of the toner 521 quality and prevent a deterioration of the image quality.

This invention is not limited to the above embodiments, but various modifications may be made. For example, in addition to the toner sensor and the polygon motor driving circuit, an electric circuit disposed near the toner box can be a source of heat generation. In this case, a judgment may be made whether the supply of electric power is necessary. Based on the result of the judgment, the supply of electric power may be controlled as described above. In the above embodiment, the drive circuit 11 for the main motor 10 is not near the toner box 520. Therefore, controlling the electric power supply to the drive circuit 11 is not necessary. If limited space, for example, requires positioning the drive circuit 11 near the toner box 520, the supply of electric power to the drive circuit 11 may be controlled in the same manner as described above for the power supply control for the drive circuit 47. Thus, the rise in temperature of the toner box can be suppressed more effectively.

The invention is applicable also to an image forming apparatus disposing the toner box in positions other than above the laser scanner unit. The invention is further applicable to an image forming apparatus provided with a process unit using a large number of apertures between a roller with toner adhered thereto and a recording medium such as paper P. In this type of image forming apparatus, the toner is ejected from the roller onto the recording medium directly and selectively according to whether a voltage is applied to each aperture.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An image forming apparatus, comprising:

a toner box that contains toner usable to develop an electrostatic latent image formed on an image bearing member;

at least one electric circuit located in a vicinity of the toner box;

discriminator means for judging, based on predetermined conditions, whether supplying electric power to the at least one electric circuit is necessary;

power supply control means for supplying electric power to said electric circuit when a result of the judgment by said discriminator means is affirmative and for not supplying electric power to said at least one electric circuit when the result of the judgment by said discriminator means is negative;

agitator means for agitating said toner; and a toner sensor that detects a residual amount of the toner in said toner box;

wherein said discriminator means judges that supplying electric power to said toner sensor is necessary only when said agitator means is in operation.

2. An image forming apparatus according to claim 1, wherein one of said predetermined conditions is whether data of a predetermined format for forming said electrostatic latent image are available for forming said electrostatic latent image.

3. An image forming apparatus according to claim 1, further comprising:

an optical member that conducts light to said image bearing member to form said electrostatic latent image; and a drive motor that drives said optical member to scan said image bearing member with said light;

wherein said at least one electric circuit includes a drive circuit that drives said motor, at least one of said drive circuit and said motor disposed in the vicinity of said toner box, wherein said discriminator means judges whether supplying electric power to said drive circuit is necessary based on whether it is necessary to drive said optical member.

4. An image forming apparatus according to claim 3, wherein said drive circuit is disposed under said toner box.

5. An image forming apparatus, comprising:

process means for forming a toner image on a recording medium using toner;

discriminator means for judging, based on predetermined conditions, whether supplying electric power to at least one electric circuit disposed in the vicinity of said process means is necessary;

power supply control means for supplying electric power to said at least one electric circuit only when supplying electric power to the at least one electric circuit is judged to be necessary by said discriminator means;

agitator means for agitating said toner; and a toner sensor that detects a residual amount of the toner in said process means;

wherein said discriminator means judges that supplying electric power to said toner sensor is necessary only when said agitator means is in operation.

6. An image forming apparatus, comprising:

a toner box that contains toner usable to develop an electrostatic latent image formed on an image bearing member;

at least one electric circuit located in a vicinity of the toner box;

a discriminator that judges, based on predetermined conditions, whether supplying electric power to the at least one electric circuit is necessary;

a power supply control device supplies electric power to said electric circuit only when the judgment by the discriminator is affirmative;

an agitator device that agitates said toner; and a toner sensor that detects a residual amount of the toner in said toner box;

wherein said discriminator judges that supplying electric power to said toner sensor is necessary only when said agitator device is in operation.

7. An image forming apparatus according to claim 6, wherein one of said predetermined conditions is whether data of a predetermined format for forming said electrostatic latent image are available to form said electrostatic latent image.

8. An image forming apparatus according to claim 6, further comprising:

an optical member that conducts light to said image bearing member to form said electrostatic latent image; and a drive motor that drives said optical member to scan said image bearing member with said light;

wherein said at least one electric circuit includes a drive circuit that drives said motor, at least one of said drive circuit and said motor disposed in the vicinity of said toner box, wherein said discriminator further judges whether supplying electric power to said drive circuit is necessary based on whether it is necessary to drive said optical member.

9. An image forming apparatus according to claim 8, wherein said drive circuit is disposed under said toner box.

10. A method of supplying power to at least one circuit in an image forming apparatus including a toner box that contains toner usable to develop an electrostatic latent image formed on an image bearing member, the at least one electric circuit located in a vicinity of the toner box, the method comprising:

judging, based on predetermined conditions, whether supplying electric power to the at least one electric circuit is necessary;

supplying electric power to the at least one electric circuit when a result of the judging step is affirmative and preventing supply of the electric power to the at least one electric circuit when the result of the judging step is negative;

agitating said toner in the toner box using an agitator; and detecting a residual amount of the toner in said toner box using a toner sensor;

wherein said judging step judges that supplying electric power to the sensor is necessary only when the agitator is in operation.

11. The method of claim 10, wherein one of said predetermined conditions is whether data of a predetermined format for forming said electrostatic latent image are available for forming said electrostatic latent image.

12. The method of claim 10, wherein said at least one electric circuit includes a drive circuit that drives a drive motor, at least one of said drive circuit and the drive motor disposed in the vicinity of said toner box, the method further comprising:

conducting light to said image bearing member to form said electrostatic image; and driving said optical member to scan said image bearing member with said light using the drive motor;

wherein the judging step judges whether supplying electric power to said drive circuit is necessary based on whether it is necessary to drive said optical member.

13. The method of claim 12, wherein said drive circuit is disposed under said toner box.

* * * * *